United States Patent [19]

Watanabe et al.

[11] Patent Number: 4,556,363

[45] Date of Patent: Dec. 3, 1985

[54] PUMPING APPARATUS

[75] Inventors: Kiyohiko Watanabe, Chiryu; Yoshiyuki Hattori, Toyoake; Toshiaki Nakamura, Anjo; Shunsaku Ohnishi, Toyota, all of Japan

[73] Assignee: Nippondenso Co., Ltd., Kariya, Japan

[21] Appl. No.: 505,849

[22] Filed: Jun. 20, 1983

[30] Foreign Application Priority Data

Jun. 21, 1982 [JP] Japan ..... 57-106392

[51] Int. Cl.[4] ..... F04D 5/00

[52] U.S. Cl. ..... 415/53 T; 415/213 T

[58] Field of Search ..... 415/53 T, 83, 120, 198.2, 415/213 T, 86, 87, 93, 98, 99, 106, 107

[56] References Cited

U.S. PATENT DOCUMENTS

| | | | |
|---|---|---|---|
| 1,146,079 | 7/1915 | Krogh . | |
| 1,611,004 | 12/1926 | Derrick . | |
| 1,619,285 | 3/1927 | Burks . | |
| 1,640,591 | 3/1927 | Borneman . | |
| 1,757,299 | 5/1930 | Ferguson . | |
| 1,768,243 | 6/1930 | Ferguson . | |
| 1,865,396 | 6/1932 | Claypool . | |
| 2,003,350 | 6/1935 | Durdin . | |
| 2,068,803 | 1/1937 | Johnson . | |
| 2,136,799 | 11/1938 | MacLean . | |
| 2,272,558 | 4/1942 | Fabig . | |
| 2,282,569 | 5/1942 | Fabig . | |
| 2,396,319 | 9/1946 | Edwards et al. | 415/213 T |
| 2,662,479 | 12/1953 | Weisenbach et al. | 415/198.2 |
| 2,696,789 | 12/1954 | Fabig . | |
| 2,704,516 | 3/1955 | Mock et al. . | |
| 2,842,052 | 7/1958 | Wright | 415/213 T |
| 2,864,552 | 12/1958 | Anderson . | |
| 3,119,343 | 1/1964 | White . | |
| 3,139,232 | 6/1964 | Peterson | 415/87 X |
| 3,160,108 | 7/1964 | Sence . | |
| 3,180,267 | 2/1965 | Bemmann et al. . | |
| 3,233,551 | 2/1966 | Oshima | 415/213 T |
| 3,258,962 | 3/1955 | Carpenter . | |
| 3,315,607 | 4/1967 | MacInnes | 415/213 T |
| 3,324,799 | 6/1967 | Terrano | 415/198.2 |
| 3,418,990 | 3/1968 | Lindell, Jr. . | |
| 3,445,693 | 3/1969 | Crawshaw et al. . | |
| 3,500,803 | 4/1970 | Long . | |
| 3,518,021 | 6/1970 | Lake et al. . | |
| 3,560,104 | 2/1971 | Neale | 415/87 X |
| 3,658,444 | 4/1972 | Rhodes et al. | 415/53 T |
| 3,779,668 | 12/1973 | Ekey | 415/141 |
| 3,782,850 | 1/1974 | Egli et al. | 415/53 T |
| 3,871,797 | 3/1975 | Igarashi et al. | 417/423 |
| 3,891,355 | 6/1975 | Hecht et al. | 417/371 |
| 3,936,243 | 2/1976 | Gakenholz | 417/423 R |
| 3,973,867 | 8/1976 | Lee | 415/143 |
| 3,995,975 | 12/1976 | Bosch | 418/74 |
| 4,209,284 | 6/1980 | Lochmann et al. | 417/366 |
| 4,212,601 | 7/1980 | Ina | 417/365 |
| 4,269,566 | 5/1981 | Spruiell | 415/112 |
| 4,295,797 | 10/1981 | Ruhl et al. | 417/203 |
| 4,336,002 | 6/1982 | Rose et al. | 417/203 |
| 4,403,910 | 9/1983 | Watanabe | 415/53 T |
| 4,445,820 | 5/1984 | Hayashi et al. | 415/53 T X |
| 4,445,821 | 5/1984 | Watanabe et al. | 415/53 T X |

FOREIGN PATENT DOCUMENTS

| | | |
|---|---|---|
| 1037860 | 3/1958 | Fed. Rep. of Germany . |
| 1062882 | 5/1959 | Fed. Rep. of Germany . |
| 2455470 | 7/1975 | Fed. Rep. of Germany . |
| 1598537 | 9/1981 | United Kingdom . |

*Primary Examiner*—Robert E. Garrett
*Assistant Examiner*—H. Edward Li
*Attorney, Agent, or Firm*—Cushman, Darby & Cushman

[57] ABSTRACT

A pumping apparatus is adapted for providing a small amount of flow rate under high pressure and includes a pumping chamber, a rotating shaft and an impeller in the form of a disk which impeller is connected at its central portion to the rotating shaft to rotate in the pumping chamber. A first pumping section of the pumping apparatus comprises a bypass regenerative pump which includes grooves formed on the opposite side surfaces of the impeller and arranged in a circle surrounding the rotating shaft, and groove-like channels formed on the wall of the pumping chamber in facing relationship to the grooves on the impeller with narrow gaps therebetween. A second pumping section of the pumping apparatus is connected in series to the first pumping section between the outer peripheral portion of the impeller and the wall of the pumping chamber, and comprises a regenerative pump which includes grooves provided on the outer peripheral portion of the impeller.

4 Claims, 14 Drawing Figures

PUMPING APPARATUS

BACKGROUND OF THE INVENTION

This invention relates to a pumping apparatus for use with automobiles as well as for industrial uses in general and for the feeding of a small amount of fuel under high pressure, and in particular to a pumping apparatus which employs the construction of a regenerative pump and/or a side channel pump in its part for the pumping action.

For example, general attention has been recently given to regenerative pumps as fuel pumps for automobiles.

However, conventional regenerative pumps are of the type for the feeding of a middle amount of fuel under high pressure and have characteristics such that the flow rate of fuel is largely varied with a change in discharge pressure. Accordingly, such regenerative pumps are not suitable as high pressure fuel pumps for vehicles which are required for feeding a small amount of fuel under high pressure and in which the flow rate of fuel is relatively slightly varied with a change in discharge pressures. In order that an one-stage type regenerative pump meets the requirements for high pressure fuel pumps, necessary measures will be taken in which sizes of flow channels representing a dimensional relationship between a pumping chamber and an impeller of this type of regenerative pump are made small or clearances defined between the impeller and the walls of the pumping chamber are made small or sizes of flow channels are made small and grooves formed in the impeller are small. However, any one of these measures is not suitable because pumping efficiencies are lowered or manufacturing costs are increased or pumping efficiencies are lowered and rotational speeds are increased to thereby increase a load on a driving motor.

Thus, with the arrangement of a prior regenerative pump, the external size thereof must be large or lateral clearances between an impeller and walls of a pumping chamber must be extremely small in order to raise discharge pressures, so that the pump occupies a large space and is difficult to manufacture.

Accordingly, there has been called for a pumping apparatus for the feeding of a small amount of fluid under high pressure which apparatus is smallsized and can discharge fluid of adequate pressure without the need of so high dimensional accuracy for the lateral clearances.

SUMMARY OF THE INVENTION

It is an object of the invention to provide a pumping apparatus which meets the above requirements.

According to the invention, a pumping action of a side channel pump section internally provided is superposed in series on a pumping action of a regenerative pump and/or a side channel pump section externally provided to feed fluid under pressure, that is, first and second pumping sections are connected in series to each other, so that when the discharge pressure is raised, such pressure rise is imposed on the two pumping sections to reduce loads on the respective pumping sections. Accordingly, a reduction in the flow rate resulted from such pressure rise can be made smaller as compared with the arrangement in which only one pump is provided. Moreover, due to the fact that pressure rises in the respective pumping sections are lower than that in a single-stage pump, lateral clearances adjacent an impeller can be made relatively large in the pumping apparatus of the invention and its manufacturing cost is inexpensive. In addition, the pumping apparatus of the invention is advantageous in that the outer diameter of an impeller can be made smaller as compared with a prior pump which includes an impeller having grooves at its peripheral edge.

DESCRIPTION OF THE PREFERRED EMBODIMENTS

Figure 1:
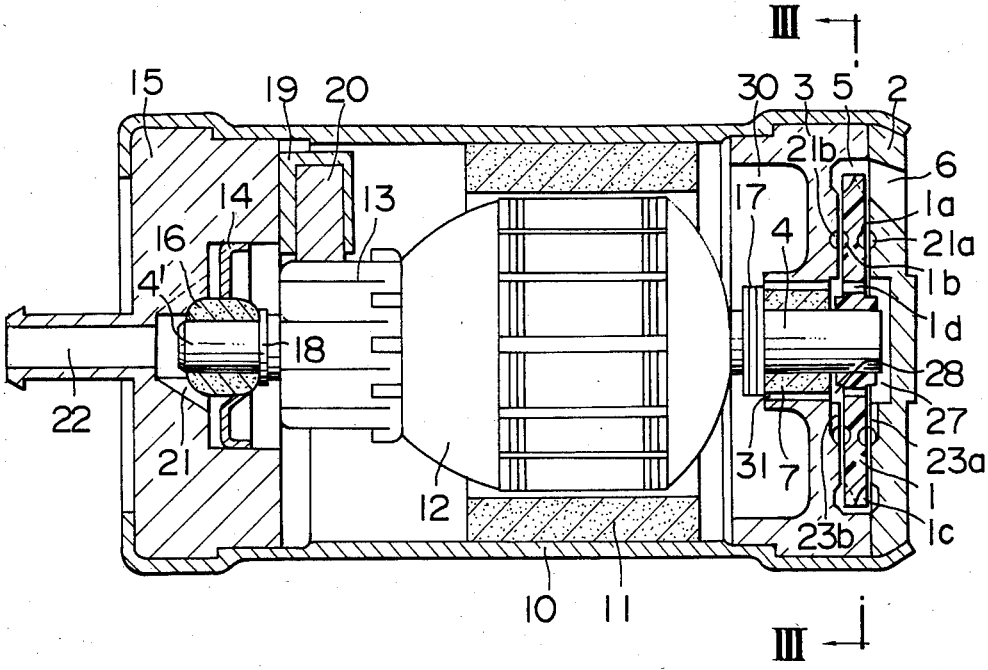
FIG. 1 is a longitudinal, sectional view showing a pumping apparatus according to a first embodiment of the invention.
Figure 2:
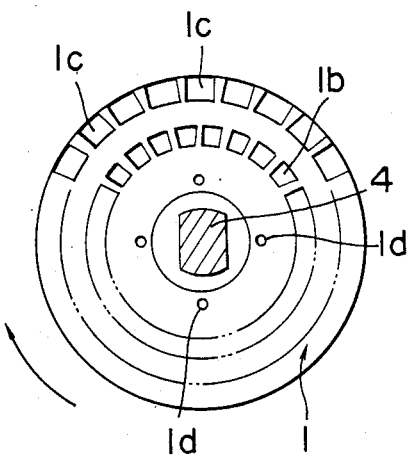
FIG. 2 is a plan view showing an impeller used in the apparatus of FIG. 1.
Figure 3:
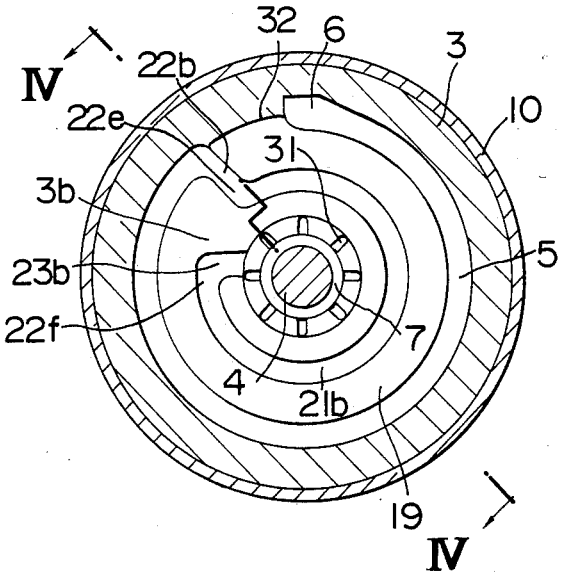
FIG. 3 is a sectional view taken along the line III—III in FIG. 1.
Figure 4:
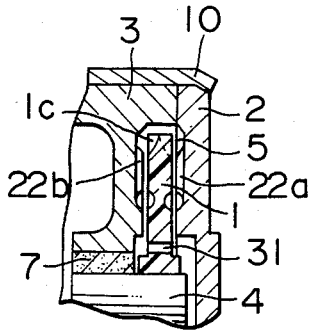
FIG. 4 is a fragmentary, sectional view taken along the line IV—IV in FIG. 3.

Referring to FIGS. 1 to 4, there is shown a pumping apparatus according to a first embodiment of the invention, which pumping apparatus is adapted for serving as a fuel pump and comprises an impeller 1 in the form of a disk disposed in a pumping chamber defined by a pump cover 2 and an end frame 3. The impeller 1 is axially movably and corotatably mounted on a motor shaft 4 which serves as a rotary shaft. As shown in FIGS. 1 and 2, the impeller 1 is formed at its opposite sides with a plurality of radially outer grooves 1*c* adjacent to the periphery of the impeller and a plurality of radially inner grooves 1*b* each having a substantially semi-circular shaped section. Also, the impeller 1 is formed near the center thereof with communicating ports 1*d* which serve to equalize the pressures in spaces 27 and 28 on the opposite sides of the impeller 1 and serve also as discharge channels for fuel. Arcuately extending grooves serving as an outer flow channel 5 are formed on the pump cover 2 and the end frame 3 in surrounding relation with the radially extending grooves 1*c* of the impeller 1. As shown in FIGS. 1 and 3, the outer flow channel 5 is communicated at its one end thereof with a suction port 6 and at the other end thereof with communicating channels 22*a* and 22*b* which in turn are connected to inner flow channels 21*a* and 21*b*, as shown in FIG. 3. The communicating channel 22*b* and the inner flow channel 21*b* are formed on the end frame 3 in facing relation with the impeller 1. The communicating channel 22*a* and the inner flow channel 21*a* are formed on the pump cover 2, as shown in FIGS. 1 and 4, respectively.

The inner flow channels 21*a and 21b* are disposed in facing relation with the radially inner grooves 1*a* and 1*b* on the impeller 1 and are in the form of arcuately extending grooves each having a substantially semi-circular shaped section. The inner flow channels 21*a* and 21*b* are connected at the one ends thereof to the communicating channels 22*a* and 22*b*, respectively, and at the other ends thereof to discharge ports 23*a* and 23*b*, respectively, as shown in FIG. 1.

As shown in FIG. 3, a partitioning portion 32 is provided on the end frame 3 between portions of the outer flow channel 5, one of which is connected to the suction port 6 and the other of which is connected to the communicating channel 22*b*. The partitioning portion 32 of the end frame 3 is sized such that a gap between it and the impeller 1 becomes as small as possible. Accordingly, there are maintained very small gaps between the sides of the impeller 1 and the pump cover 2 and the end frame 3. A pumping channel defined by the radially outer grooves 1*c* of the impeller 1, the outer flow channel 5 and the partitioning portion 32 is called hereinbelow as a first pumping section which constitutes a regenerative pump. Pumping channels defined by the radially inner grooves 1*a* and 1*b* and the inner flow channels 21*a* and 21*b* are called hereinbelow as a second pumping section.

The discharge ports 23*a* and 23*b* are opened to the spaces 27 and 28, respectively, which are communicated to an inner chamber 30 through a plurality of discharge ports 31 provided around a bearing 7 press fitted into the end frame 3.

A motor section comprises a permanent magnet 11 secured to a casing 10, an armature 12, a commutator 13 and a shaft section 4' which is journaled by a bearing 16 supported by an end housing 15 and a retainer 14. The motor section is held in place by spacers 17 and 18 in the axial direction. Secured to the end housing 15 is a brush holder 19 for the supporting of a brush 20. The end housing 15 is provided with a discharge channel 21 and a discharge pipe 22. The pump cover 2, end frame 3 and the end housing 15 are integrally assembled by the casing 10 serving as a yoke. The fuel pump thus constituted in the above manner is normally mounted in a fuel tank.

In operation, the motor section is actuated by the rotation of the armature 12 which is caused by a voltage applied on the commutator 13 through the brush 20 from an electric source (not shown). Accordingly, the impeller 1 is rotated in an arrow direction in FIG. 2 to cause fuel in the fuel tank to be drawn into the fuel pump through the suction port 6. The fuel thus drawn is raised in pressure (first stage of pressure-rise) by the first pumping section which is formed by the radially outer grooves 1*c* (FIG. 1) and the outer flow channel 5, and is transferred through the communicating channels 22*a* and 22*b* to the second pumping section, which is formed by the radially inner grooves 1*a* and 1*b* and the inner flow channels 21*a* and 21*b*, to be raised in pressure (second stage of pressurerise). The fuel raised in pressure by the second pumping section is discharged via the discharge ports 23*a* and 23*b* to the spaces 27 and 28, respectively. The fuel discharged to the space 27 is discharged to the chamber 30 through the communicating ports 1*d* and the discharge ports 31 and the fuel discharged to the space 28 is discharged to the chamber 30 through the discharge ports 31. The fuel discharged to the chamber 30 is discharged to the outside via the discharge port 22 while cooling off the armature 12.

Figure 5A:
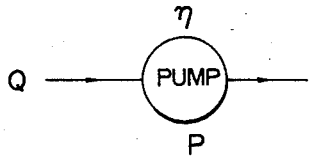
FIG. 5A is a diagrammatic view showing a prior single-stage pump.
Figure 5B:
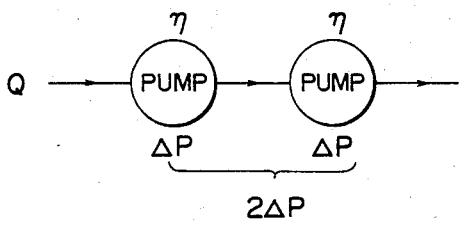
FIG. 5B is a diagrammatic view showing a two-stage pump.
Figure 6:
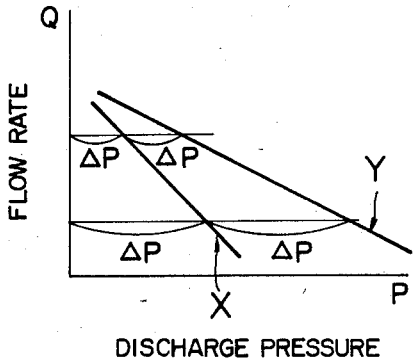
FIG. 6 is a graph showing characteristics of the prior single-stage pump and the two-stage pump.

The fuel pump constructed according to the first embodiment of the invention can be regarded as an equivalent to two-stage pumps connected in series to each other, as shown in FIG. 5B. In terms of capacity, FIG. 6 shows two characteristic curves X and Y for a conventional one-stage pump as shown in FIG. 5A and a two-stage pump as shown in FIG. 5B. In FIG. 6, the ordinate represents flow rates Q and the abscissa represents discharge pressures P. For a particular flow rate, the magnitude of discharge pressure in the characteristic curve Y amounts to approximately two times that in the characteristic curve X. Namely, the rate $\Delta Q/\Delta P$ of a change of discharge flow rate to a change of discharge pressure is reduced in two-stage pumps. Furthermore, in case two pumps constituting a two-stage pump have the same pump efficiency $\eta$, the pump efficiency $\eta'$ of the two-stage pump will be substantially equal thereto. Accordingly, the present invention embodies a two-stage pump provided with an impeller, which pump provides a small flow rate with high pressures and the discharge flow rate of which pump does not vary so much even if the discharge pressure of the pump is changed. Such construction makes the pump of the present invention inexpensive in manufacture.

Figure 7:
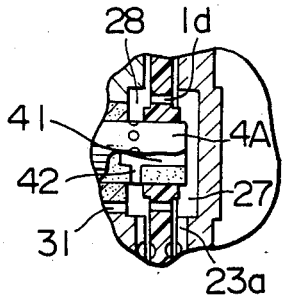
FIG. 7 is a fragmentary, sectional view showing a pumping apparatus according to a second embodiment of the invention.

FIG. 7 shows a second embodiment of the present invention, in which there is formed a blind hole 41 and a plurality of radially extending communication holes 42 in the motor shaft 4A on the side of the pump, said communication holes 42 serving to communicate the blind hole 41 to the space 28 in the pump. With such arrangement, an amount of fuel discharged into the space 27 through the discharge port 23*a* can be conducted to the discharge ports 31 through the blind hole 41 and the communication holes 42 as well as through the communicating ports 1*d*, thereby enabling reducing a resistance encountered upon discharge of fuel. Except for the above, the second embodiment is the same as the first embodiment in terms of constitution, function and effects.

Figure 8:
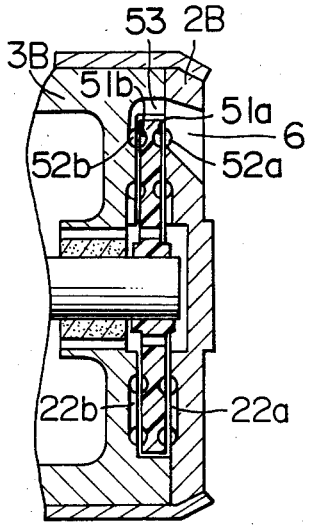
FIG. 8 is a fragmentary, sectional view showing a pumping apparatus according to a third embodiment of the invention.

FIG. 8 shows a third embodiment of the present invention, of which a first stage pump is constituted by a plurality of grooves 51*a*, 51*b*, the pump cover 2B, the end frame 3B, and outer flow channels 52*a*, 52*b*. The grooves 51*a*, 51*b* are semi-circular-shaped in section and are formed radially outwardly on the opposite sides of the impeller 1. The outer flow channels 52*a*, 52*b* are substantially semi-circular shaped in section and are in the form of arcuate grooves. The flow channels are disposed in facing relationship with the grooves 51*a*, 51*b*. The first stage pump is usually called a side channel pump. On the end frame 3B is formed a suction channel 53 in facing relationship with the suction port 6 so as to permit fuel to be sucked into the outer flow channel 52*b*.

In operation, fuel is sucked into the first stage pump through the suction port 6 and the suction channel 53, and is raised in pressure to a higher level while passing through the outer flow channels 52*a*, 52*b* to be fed to the second stage pump through the communicating channels 22*a* and 22*b*. Thereafter, the fuel is conducted in the same manner as in the first embodiment.

Figure 9:
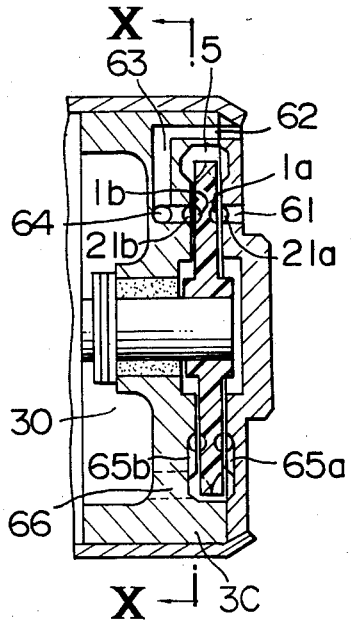
FIG. 9 is a fragmentary, sectional view showing a pumping apparatus according to a fourth embodiment of the invention.
Figure 10:
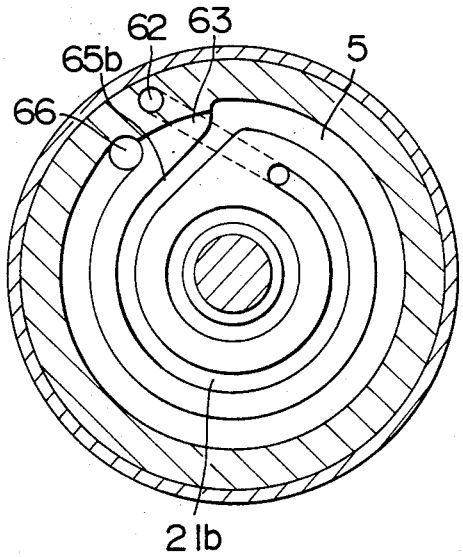
FIG. 10 is a sectional view taken along the line X—X in FIG. 9.

Referring now to FIGS. 9 and 10, there is shown a fourth embodiment of the present invention, in which there are provided suction ports 61, 62, a suction hole 63 and a suction port 64, these ports and hole serving as a suction channel leading to a side channel pump provided internally of the pump. Communication channels 65*a*, 65*b* connect the outer flow channel 5 to the inner flow channels 21*a*, 21*b* of the side channel pump, respectively, and a discharge port 66 formed in the end frame 3C communicates the outer flow channel 5 to the chamber 30 in the motor.

In operation, fuel is drawn through the suction ports 61, 62, suction hole 63 and the suction port 64 into the first stage pump, that is, the bypass regenerative pump formed within the pump of the present invention. Thus the fuel is raised in pressure to a higher level in the first stage pump, and is fed to the second stage pump provided outside of the pump via the communication channels 65*a*, 65*b* to be raised in pressure to a higher level. The fuel discharged from the second stage pump is fed to the space 30 in the motor section. As described above, the first stage pump is provided inside of the pump and the second stage pump is provided outside of the pump, so that the fuel is smoothly discharged to the chamber 30 in the motor section and the pressures on the opposite sides of the impeller 1 are balanced to each other to enable rotating the impeller at the center of the pumping chamber.

Figure 11:
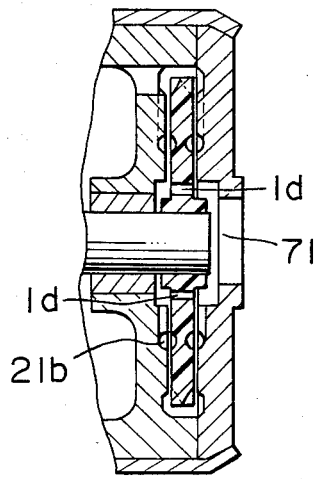
FIGS. 11, 12 and 13 are fragmentary, sectional views showing pumping apparatus according to fifth, sixth and seventh embodiments of the invention, respectively.

FIG. 11 shows a fifth embodiment of the present invention which is a partial modification of the fourth embodiment of the present invention. In the fifth embodiment, a suction port 71 is provided at the center of the pump cover for drawing the fuel into the first stage pump without the provision of any complicated suction path. With the arrangement of the fifth embodiment, the fuel is drawn via the communicating ports 1*d* into the inner flow channel 21*b*.

Figure 12:
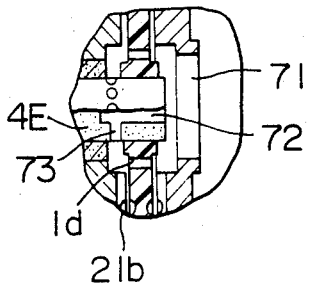

FIG. 12 shows a sixth embodiment of the present invention which is a partial modification of the fifth embodiment of FIG. 11. With the arrangement of the sixth embodiment, fuel is drawn into the inner flow channel 21*b* via a blind hole 72 and a plurality of communicating apertures 73, respectively, formed in the shaft 4E as well as via the communicating ports 1*d*.

The effects of the present invention can be obtained by using as a side channel pump a single-sided impeller having grooves on its one side surface, unlike the impeller 1 having grooves 1*a* and 1*b* as shown in FIG. 1.

Figure 13:
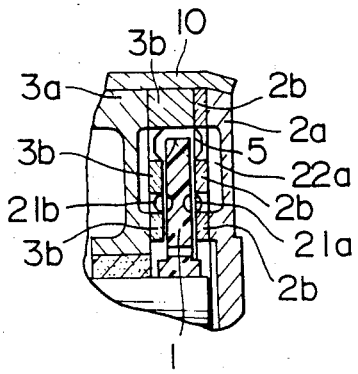

FIG. 13 shows a seventh embodiment of the present invention in which the pump cover 2 and the end frame 3 in the first embodiment are somewhat modified. In FIG. 4 the communicating channels 22*a* and 22*b* are directly opened to the periphery of the impeller 1 while corresponding communicating channels 22*a* and 22*b* in the seventh embodiment are constructed so as not to be directly opened to the periphery of the impeller 1, thereby reducing clearances between the impeller 1 and the inner walls of the pumping chamber to the utmost to minimize internal leakage in the pump. The term "internal leakage" in a pump means leakage of fluid from a discharge side to a suction side through clearances between an impeller and walls of a pumping chamber. Such internal leakage brings about inefficiency.

Referring now to FIG. 13, first and second pump covers 2*a*, 2*b*, first and second end frames 3*a*, 3*b* joined together by the caulking of the casing 10. Inner flow channels 21*a* and 21*b* are formed in the second pump cover 2*b* and the second end frame 3*b*, and an outer flow channel 5 is formed in the second end frame 3*b*. A communicating channel 22*a* is defined between the first pump cover 2*a* and the second pump cover 2*b*, and a communicating channel 22*b* is defined between the first end frame 3*a* and the second end frame 3*b*. Accordingly, clearances defined between the outer surface of the impeller 1 and the second pump cover 2*b* and between the outer surface of the impeller 1 and the second end frame 3*b* can be minimized, internal leakage which incurs a loss in a pump can be reduced.

Many modifications and variations of the invention will be apparent to those skilled in the art in view of the foregoing detailed disclosure. Therefore, it is to be understood that, within the scope of the appended claims, the invention can be practiced otherwise than as specifically shown and described.

We claim:

1. A pumping apparatus comprising:

pump housing means having a pump chamber therein;

a rotary shaft supported in said pump housing means;

an impeller supported on and drive by said rotary shaft and rotatably disposed in said pump chamber;

a first series of grooves formed on both sides of said impeller at its outer periphery;

a second series of grooves formed on both sides of said impeller radially inwardly of said first series of grooves;

first flow channel means formed in said pump housing means opposing to said first series of grooves for forming one stage of regenerating pump section;

a pair of second flow channels respectively formed in side walls of said pump housing means opposing to said second series of grooves, to thereby form another stage of regenerating pump section; and communicating channels respectively formed in the side walls of said pump housing means for communicating said first flow channel means with said second flow channels, whereby said one stage of regenerating pump section is connected in series with said other stage of regenerating pump section;

an inlet portion formed in said pump housing means and communicated to said first flow channel means;

a pair of spaces formed in said pump housing means and on both sides of said impeller at its center;

a pair of discharge channels respectively formed in side walls of said pump housing means for communicating said second flow channels with said spaces, respectively;

a through port in the form of a through hole formed in said impeller near said rotary shaft for communicating said spaces with each other;

a discharge port formed in said pump housing means and communicated with said spaces for discharging high pressure fuel out of said pump chamber; and passage means formed in said rotary shaft, said passage means extending along the longitudinal axis of said rotary shaft and having opening means at one end communicating laterally outwardly of said rotary shaft, said passage means being constructed and arranged for communicating one of said spaces with the other of said spaces.

2. A pumping apparatus as set forth in claim 1, said passage means comprising:

a bore formed in one end of said rotary shaft and opening to one of said spaces; and an aperture formed in said rotary shaft for communicating said bore with the other of said spaces.

3. A pumping apparatus comprising:

pump housing means having a pump chamber therein;

a rotary shaft supported in said pump housing means;

an impeller supported on and driven by said rotary shaft and rotatably disposed in said pump chamber;

a first series of grooves formed on both sides of said impeller at its outer periphery;

a second series of grooves formed on both sides of said impeller radially inwardly of said first series of grooves;

a first flow channel means formed in said pump housing means opposing to said first series of grooves for forming one stage of regdnerating pump section;

a pair of second flow channels respectively formed in side walls of said pump housing means opposing to said second series of grooves, to thereby form another stage of regenerating pump section; and communicating channels respectively formed in the side walls of said pump housing means for communicating said first flow channel means with said second flow channels, whereby said one stage of regenerating pump section is connected in series with said other stage of regenerating pump section;

a pair of spaces formed in said pump housing means and on both sides of said impeller at its center;

a through port in the form of a through hole formed in said impeller near said rotary shaft for communicating said spaces with each other;

an inlet port formed in said pump housing means and communicated with said spaces;

a pair of inlet chambers formed in said pump housing means for communicating said spaces with said second flow channels, respectively;

discharge port formed in said pump housing means and communicated with said first flow channel means for discharging high pressure fuel out of said pump chamber; and passage means formed in said rotary shaft, said passage means extending along the longitudinal axis of said rotary shaft and having opening means at one end communicating laterally outwardly of said rotary shaft, said passage means being constructed and arranged for communicating one of said spaces with the other of said spaces.

4. A pumping apparatus as set forth in claim 3, wherein:

said rotary shaft comprises a blind hole and a plurality of communicating apertures, said passage means formed in said blind hole being axially formed in said rotary shaft and communicated to one of said spaces, said communicating apertures being radially formed in said rotary shaft and communicating said blind hole with the other of said spaces.

* * * * *